US006325300B1

(12) United States Patent
Igwemezie

(10) Patent No.: US 6,325,300 B1
(45) Date of Patent: Dec. 4, 2001

(54) RAIL RETAINING DEVICE

(76) Inventor: Jude O. Igwemezie, 1020 Denison Street, Suite 207, Markham, Ontario (CA), L3R 3W5

( * ) Notice: Subject to any disclaimer, the term of this patent is extended or adjusted under 35 U.S.C. 154(b) by 0 days.

(21) Appl. No.: 09/512,459

(22) Filed: Feb. 24, 2000

Related U.S. Application Data

(63) Continuation-in-part of application No. PCT/CA98/00824, filed on Aug. 28, 1998.

(51) Int. Cl.[7] ..... E01B 13/00
(52) U.S. Cl. ..... 238/348; 238/345; 238/351
(58) Field of Search ..... 238/310, 338, 238/341, 343, 345, 348, 349, 351, 355, 356

(56) References Cited

U.S. PATENT DOCUMENTS

| | | | | |
|---|---|---|---|---|
| 816,575 | | 4/1906 | Gardin . | |
| 2,085,970 | | 7/1937 | Greene | 239/349 |
| 2,281,750 | * | 5/1942 | Clarkson | 238/349 |
| 2,333,518 | * | 11/1943 | Burkhardt | 238/351 |
| 4,325,510 | * | 4/1982 | Sherrick | 238/341 |
| 4,600,145 | | 7/1986 | Geddes | 238/351 |
| 4,705,215 | * | 11/1987 | Eisenberg et al. | 238/349 |
| 4,967,945 | | 11/1990 | von Lange | 238/310 |
| 5,083,706 | * | 1/1992 | Bratchell | 238/351 |

FOREIGN PATENT DOCUMENTS

| | | |
|---|---|---|
| 105110 | 4/1898 | (DE) . |
| 191857 | 11/1907 | (DE) . |
| 228433 | 11/1910 | (DE) . |
| 393023 | 12/1908 | (FR) . |
| 1061959 | 5/1954 | (FR) . |
| 345856 | 4/1931 | (GB) . |
| 1474698 | 5/1977 | (GB) . |
| 94/28245 | 12/1994 | (WO) . |

* cited by examiner

*Primary Examiner*—Mark T. Le
(74) *Attorney, Agent, or Firm*—Ridout & Maybee LL

(57) ABSTRACT

A rail retaining device has a shoulder that has a body portion, a hook-in leg portion and a bearing portion, and adapted to be pivoted from an installation position. To install the device, the body portion is inclined relative to a plate form tie, and the hook-in leg portion is inserted through an aperture in the tie. The shoulder is moved to an erected position, in which the hook-in leg portion engages an underside of the plate tie and the bearing portion engages on an upper side of the tie. A clip is located relative to the shoulder by engagement with the shoulder is inserted between a side surface of the body portion and a rail flange and retains the shoulder in an erected position.

12 Claims, 5 Drawing Sheets

RAIL RETAINING DEVICE

This application is a continuation-in-part of International patent application PCT/CA98/00824 filed Aug. 28, 1998.

The present invention relates to a rail retaining device comprising a hook-in shoulder and clip for fastening a rail relative to a plate, for example relative to a plate form tie. The hook-in shoulder is adapted to retain a rail flange from displacing laterally due to, for example, forces from the train wheel, and usually will be provided with means adapted to retain the flange from lifting due to rail roll.

With known hook-in shoulder arrangements of which applicant is aware, the shoulder is in direct contact with the rail flange, and the known arrangements suffer from the disadvantage that the shoulder member is prone to rapid wear as a result of vibration or other movements of the rail flange relative to the shoulder member. Often, the hook-in shoulder member is a metal casting, and therefore tends to be relatively soft and vulnerable to rubbing wear, with the result that the shoulder member is no longer able to maintain a fastening or gauge maintaining arrangement relative to the rail.

British patent No. 345,856, dated Apr. 2, 1931 in the name Paddon, shows a hook-in shoulder with a wedging key interposed between the shoulder and the rail flange. However, the wedging key is free to slide longitudinally of the rail and is susceptible to vibration longitudinally of the rail that results in the key loosening and eventually detaching from the shoulder.

In the present invention there is provided a retaining device retaining a rail flange of a rail relative to a plate form member comprising: (A) a shoulder having a body portion, a hook-in leg portion and a bearing portion, and pivoting from an installation position, wherein the body portion is inclined relative to said plate form member, and said hook-in leg portion is inserted through an aperture in said plate form member, to an erected position, wherein the hook-in leg portion engages an underside of said plate form member and said bearing portion engages on an upper side of said plate form member; and wherein said shoulder is provided with an arm extending transversely of said body portion and extending above and bearing toward said rail flange, a side surface disposed on a side of said body portion below the arm, and opposite end surfaces on an upper portion of the body portion facing generally longitudinally of said rail; and (B)a clip member located relative to the shoulder by engagement therewith and comprising first and second upper limbs snap fitting over said opposite end surfaces, respectively, and a lower limb inserted between said side surface of said body portion and said rail flange and retaining said shoulder in said erected position and preventing rotation of said shoulder about a vertical axis.

With this arrangement, the clip member is interposed between the rail flange and the shoulder member and prevents the shoulder member from rotating so as to disengage the arm from the rail flange. The clip member may readily be formed of material that is harder than the shoulder member and is not liable to become worn as a result of rubbing contact with the rail flange. Since the clip member is located relative to the shoulder member, as a result of the limbs snap fitting over the end surfaces of the body portion, the clip member does not tend to vibrate relative to the shoulder member, and does not tend to cause wear of the shoulder member.

The present invention will now be described in more detail by way of example only with reference to the accompanying drawings, in which.

Figure 1:
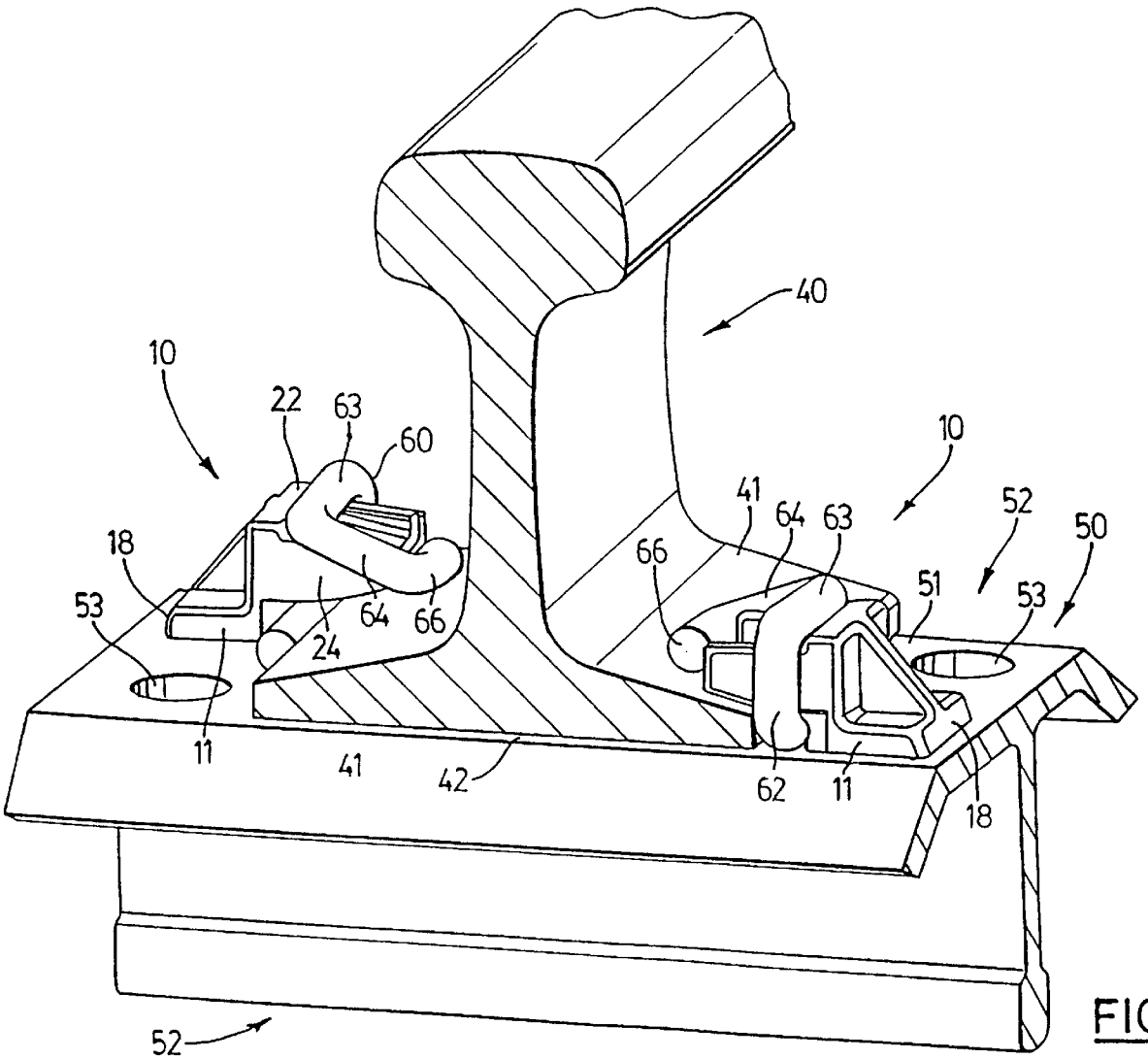
FIG. 1 is an isometric view of a rail fastening arrangement in accordance with the invention.

Referring to the drawings, these show a fastening arrangement 10 used for fastening a rail 40 to a plate form support 50. In this example, the plate form support 50 comprises a horizontal plate 51 of a steel tie 52 as described and shown, for example, in applicant's international patent applications Nos. WO 94/28245 and WO 96/23017 to which reference should be made for further details. For simplicity and clarity of illustration, only short sections of the rail 40 and of the tie 52 are shown in the accompanying drawings.

Figure 6:
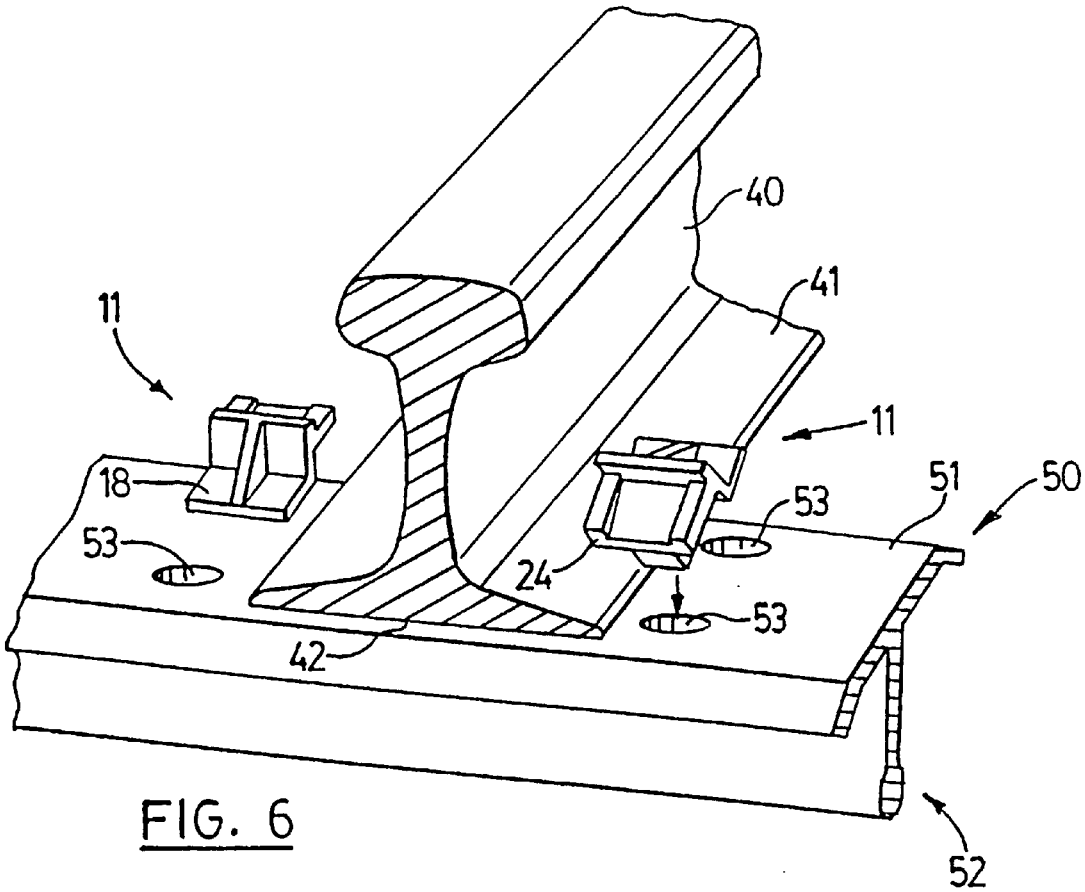
FIG. 6 is a perspective view of the rail fastening arrangement in the course of installation of a shoulder member.

As best seen in FIG. 6, the plate 51 is provided with two cylindrical openings 53 on each side of the rail flange 41 of the rail 40.

Figure 3:
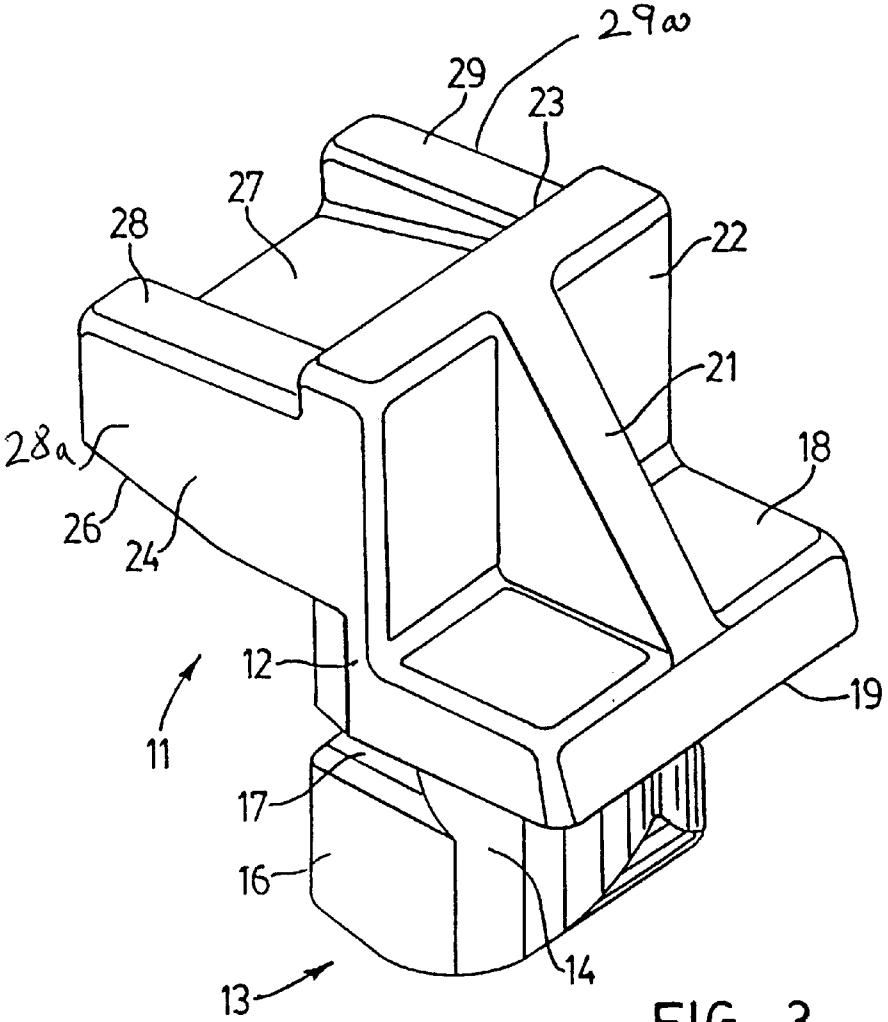
FIG. 3 is an isometric view of the shoulder member from above and from the rear.
Figure 2:
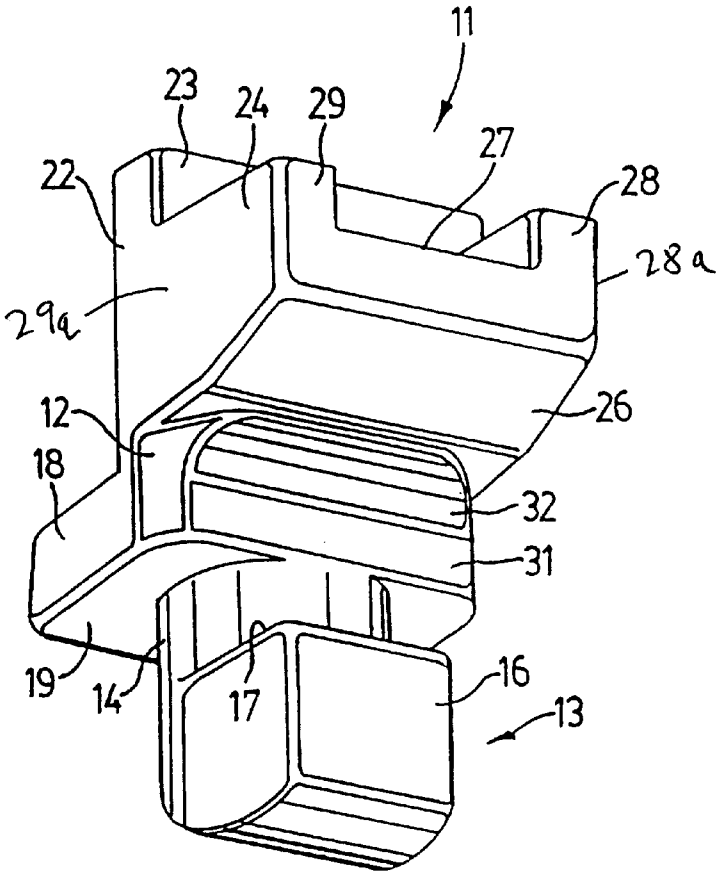
FIG. 2 is an isometric view on an enlarged scale of a shoulder member taken from the front and from beneath.

A first component of the fastening arrangement 10 is a hook-in shoulder 11 as best seen in FIGS. 2 and 3. The shoulder 11 comprises a body portion 12 having a lower hook-in leg portion 13 that comprises a generally cylindrical stem 14 and a transversely projecting foot portion 16 having a generally planar upper side 17.

A generally rectangular flange-like bearing portion 18 extends laterally from the body portion 12 in a direction opposite to the foot portion 16 and has a generally planar lower side 19 generally parallel to and spaced vertically from the upper surface 17 by a distance slightly greater than the thickness of the plate 41.

The bearing portion 18 is braced through a generally triangular fillet portion 21 that connects integrally between an upper side of the portion 18 and a rear face of an upper generally rectangular portion 22 of the body portion 12. An upper front surface 23 of the upper portion 22 provides an abutment portion facing forwardly, below which an arm portion 24 extends forwardly from the upper portion 22. The lower side of the arm portion 24 is chamfered at 26, so that the arm portion 24 generally tapers in thickness outwardly from the upper portion 22 of the body portion 12. The chamfered portion 26 is generally inclined relative to the planar surfaces 17 and 19 at an angle approximately matching the angle that the upper side of the rail flange 41 defines with respect to the planar base surface 42 of the rail 40.

A central portion 27 of an upper side of the arm portion 24 is recessed downwardly, and preferably inclines downwardly away from the upper portion 22, and is disposed between two relatively raised end wall portions 28 and 29.

Beneath the arm 24, the body portion 12 is provided with a planar surface 31 facing generally in the same direction as the arm 24 and foot portion 16. The planar portion 31 presents a linear profile extending longitudinally of a side surface of the body portion 12. Above the planar surface 31, the side surface of the body portion 12 is formed with a cylindrical surface 32 that forms a transition upwardly from the planar surface 31 to the lower side of the arm 24.

Figure 4:
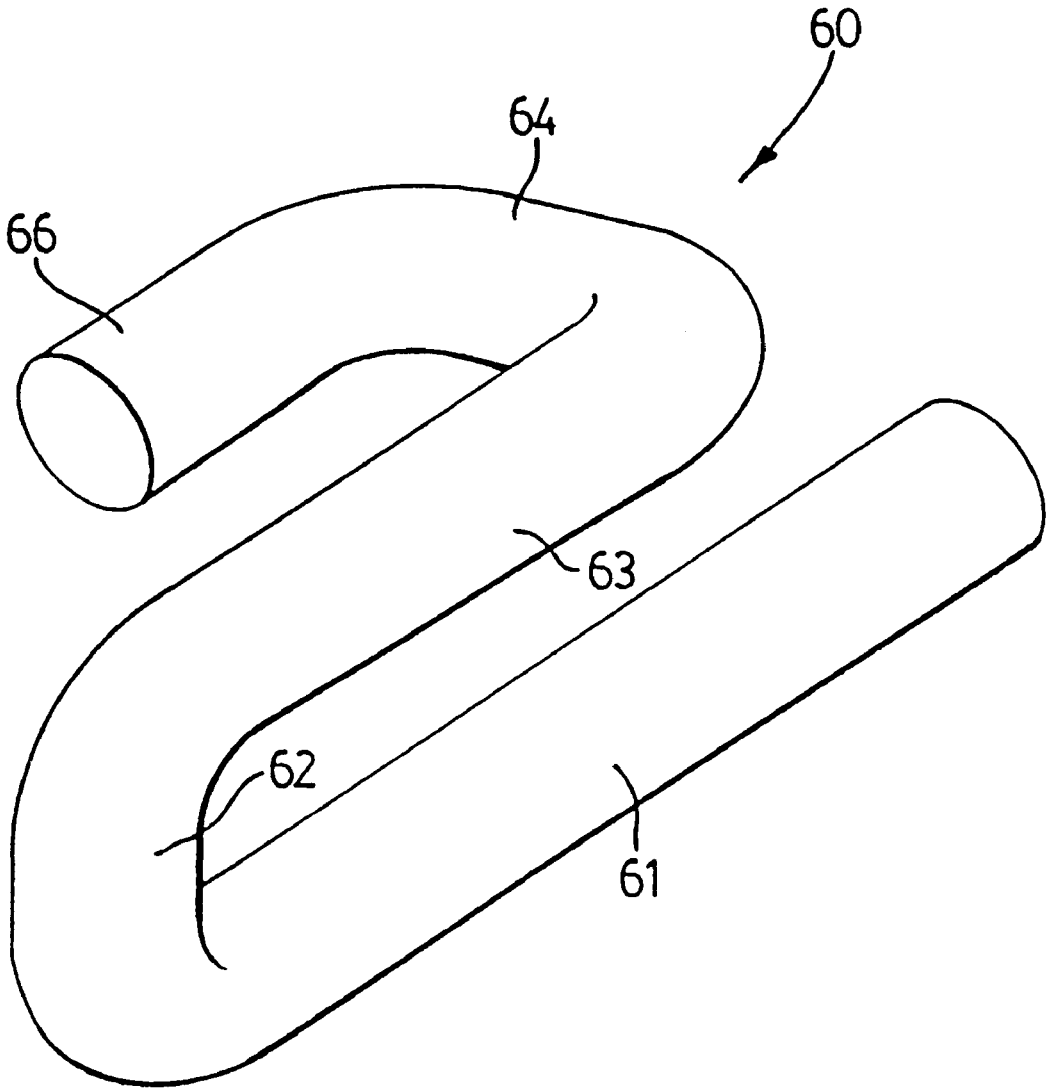
FIG. 4 is an isometric view of a preferred rod-form clip used in the fastening arrangement of the invention.

A second component of the fastening arrangement 10 comprises a rod form clip 60, as best seen in FIG. 4, formed, for example, from bent steel rod. The clip comprises a generally C-shaped lower portion comprising a longitudinal lower limb 61 connected through a first upper limb comprising an intermediate limb portion 62 extending generally at right angles to the lower limb 61, and an upper longitudinal limb portion 63 disposed in the same plane as limbs 61 and 62, and preferably inclining downwardly toward limb 61 in the direction away from limb 62 at a small angle. For example, limb portion 63 may incline at an angle of about 2° to about 10°, more preferably about 4°, with respect to limb 61.

Limb portion 63 is provided with a second upper limb comprising a transverse limb 64 that inclines downwardly, in the direction toward the lower longitudinal limb 61 in the direction away from the plane occupied by the limbs 61, 62 and 63. For example, the arm 64 may form an angle of about 50 to about 80°, more preferably about 67°, with respect to the said plane.

The transverse limb 64 is provided with a further longitudinal limb 66 that extends parallel to the plane occupied by the limb 61, 62 and 63 and on the same side of limb 64 as limb portion 63.

In use, the shoulder 11 is inserted through an opening 53, as shown in FIG. 6. To facilitate insertion, and to avoid interference of the arm portion 24 with the rail flange 41, usually it is desirable to incline the foot portion 16 and arm portion 24 downwardly approximately longitudinally parallel with and along side the rail 40, as seen in FIG. 6. Once the foot portion 16 and cylindrical stem 14 have passed through the opening 53, the shoulder can be rocked to an erected position as seen at the left hand half of FIG. 6, wherein the planar lower side 19 of the bearing portion 18 engages on the upper surface of the plate 51.

Figure 7:
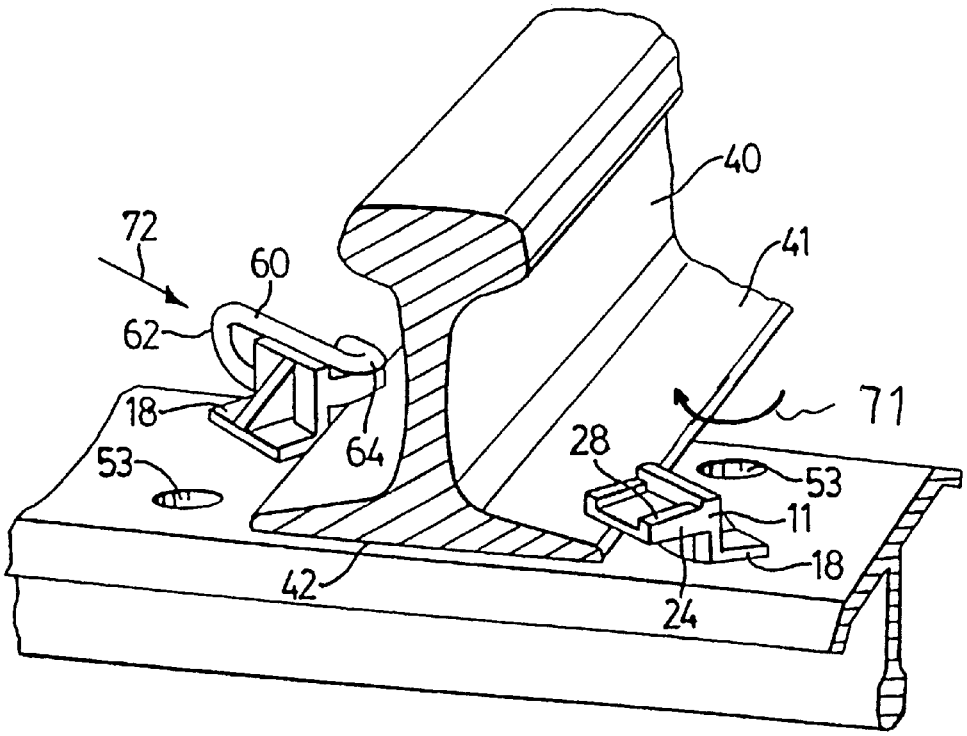
FIG. 7 is a perspective view corresponding to FIG. 6 showing a later stage in the installation procedure.

The shoulder 11 is rotated about a vertical axis of the stem 14 (as well as about a vertical axis of the opening 53), in the direction shown by the arrow 71 in FIG. 7, so that the arm 24 partially overlaps the rail flange 41. The rod form clip 60 is then applied to the assembly. The lower limb 61 is inserted in the space between the front planar surface 31 of the body portion 12 of the shoulder member 11, in a position underlying the arm. The transverse limb 64 is ledged loosely on the upper side of the wall portion 28, with the lower limb 61 extending under the arm 24 adjacent the upper side of the plate 51.

The clip 60 is then driven inwardly, in the direction indicated by the arrow 72 in FIG. 7 by pressure applied on the outer side of the intermediate portion 62 of the clip. This force may be applied by a percussive installation tool, for example a mallet or the like. Since the plane of the limb 61, 62 and 63 in the initial installation position, as seen in FIG. 7 is slightly forward of the axis of the stem portion 14 of the shoulder 11, the clip installing force exerts a rotational moment tending to swing or rotate the shoulder member inwardly to the installed position seen in FIGS. 1 and 5 wherein the arm 24 extends laterally over the rail flange 41.

Figure 5:
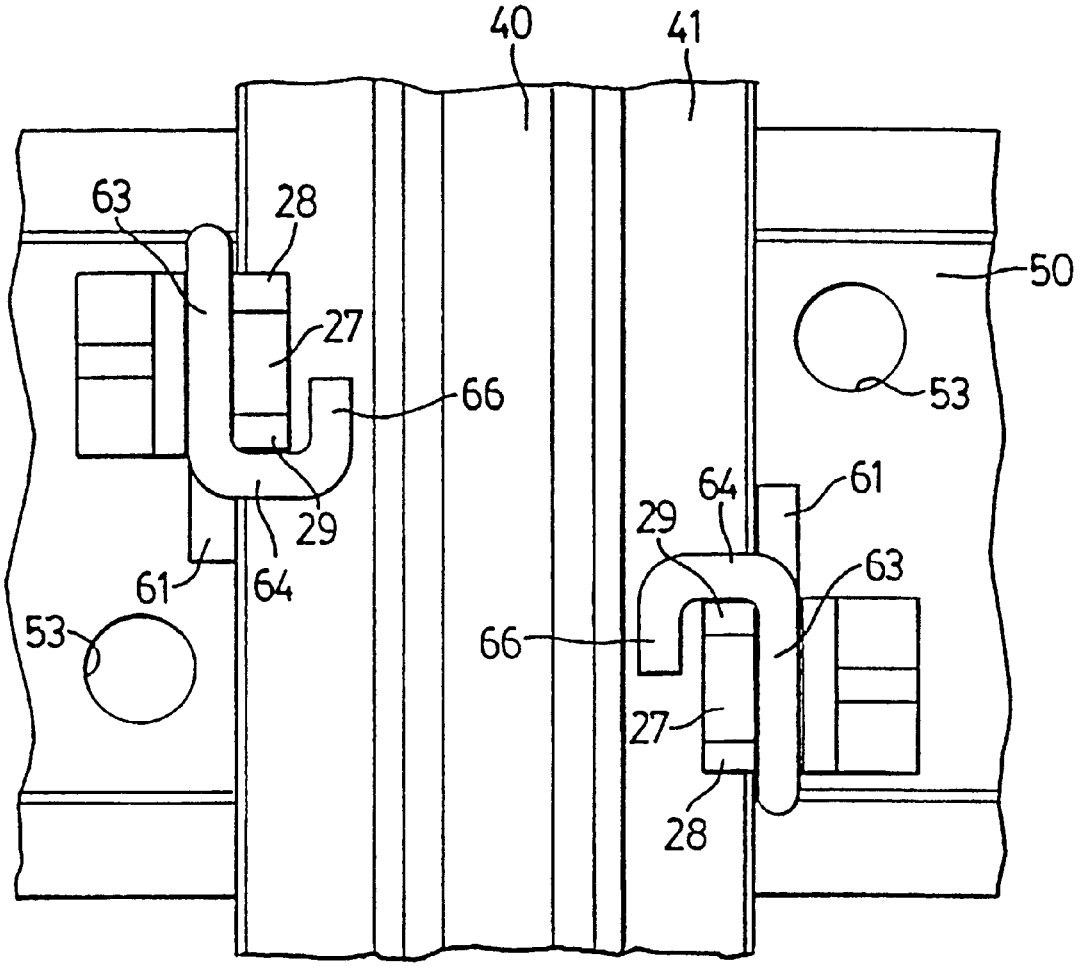
FIG. 5 is a plan view of the assembly of FIG. 1.

As the clip 60 is driven inwardly in the direction of the arrow 72, the upper limb portion 63 and transverse limb 64 are deflected resiliently upwardly relative to the lower limb 61 with the result that there is a strong downwardly directed resilient reaction between the transverse limb portion 64 and the shoulder member 11 as the transverse portion 64 rides over and snaps firstly over the first end wall portion 28 into the recess 27 and secondly as it rides over the second end wall portion 29 and snaps downwardly beyond the end wall portion 29 on the upper surface of the rail flange 41 as seen in FIGS. 1 and 5. The edges and corners of the shoulder are somewhat rounded to facilitate this movement.

In the installed condition as seen in FIGS. 1 and 5, limb 64 and further longitudinal limb 66 are deflected resiliently upwardly somewhat relative to their neutral or normal position, so that there is a small resilient reaction between the further longitudinal limbs 66 and the rail flange 41, while the upper limb 63 bears resiliently downwardly and rearwardly on the shoulder member 11, tending to seat the bearing portion 18 downwardly toward the plate 51. This resilient reaction tends to retain the elements of the assembly tightly together, so that free play and rattling are avoided.

In the installed position, the upper limb 63 is deflected resiliently upwardly away from the lower limb portion 61, so that there is a resilient reaction between the limb 61 and 63 and the lower and upper sides of the arm 24, respectively, and the limb portions 61 and 63 tend to grip frictionally on the lower and upper sides of the arm 24. The limbs 62 and 64 are snap fitted over the upper portion of the shoulder and engage the opposing longitudinally facing end faces 28*a* and 29*a* of the walls 28 and 29, respectively, and resist longitudinal movement of the clip 60 relative to the shoulder member 11.

In the installed position, as seen in FIGS. 1 and 5, the lower limb 61 extends between the rail flange 41 and the shoulder 11, and is engaged on one side by the planar and part cylindrical portions 31 and 32, and on an opposite side by the laterally outer edge of the rail flange 41. Hence, direct rubbing contact between the rail flange 41 and the side of the shoulder member 11 is avoided. Movement between the rail 40 and the shoulder member 11 results in rubbing contact between the rail flange 41 and the rod form clip 60, but since this is formed of sturdy wire rod it is relatively highly resistant to abrasive wear.

Further, the longitudinal distance between the intermediate limb 62 and transverse limb 64 is approximately the length of the arm 24, so that the rod form clip 60 snap fits snugly onto the arm portion 24 of the shoulder 11 and is not liable to be vibrated longitudinally relative to the shoulder member 11. In this way, abrasive wear as a result of movement of the rod form clip 60 relative to the shoulder 11 is largely or wholly eliminated, and hence the arrangement effectively retains gauge and resists lateral rail movement.

It may be noted that, in the installed position, the lower limb 61 of the clip 60 is lodged snugly between the outer edge of the rail flange 41 and the planar linear surface 31 of the shoulder member 11. In this position, the rod member 60 functions in part to retain the shoulder member 11 in an erected position wherein the bearing portion 18 maintains contact with the upper side of the plate form member 51, and avoids any tendency for the shoulder member to pivot to an inclined position such as might allow the stem 14 and foot portion 16 to disengage upwardly through the aperture 53. The shoulder member is thereby retained in an erected condition in which it resists lateral pressure exerted by the rail 40, and retains the rail gauge.

Further, the limb 61 engaged between the side surface 31 and the rail flange 41 resists rotation of the shoulder member about a vertical axis of the stem 14 such as would tend to result in the arm 24 rotating sideways so that it no longer overlies the rail flange 41. In the installed position, therefore, the clip 60 retains the shoulder member with the arm 24 overlying the rail flange 41. In this position, uplift of the rail flange 41 relative to the plate member 51 and that would tend to cause upward movement of the shoulder 11 is limited or prevented by engagement of the upper surface 17 of the foot portion 16 engaging on the underside of the plate form member 51.

Various modifications to the structure as described above in detail are contemplated. For example, the foot 16 may be directed oppositely to the direction shown in FIGS. 2 and 3 and may extend from the stem 14 on the same side as the bearing portion 18. This arrangement is, however, less preferred, since rail uplift imposes a bending stress on the shoulder member which is less easily resisted than the substantially direct tensile stress exerted on the shoulder member in resisting rail flange uplift in the case in which the foot portion 16 extends underneath the arm 24.

As noted above, the clip member 60 serves to retain the shoulder 11 in an upright or erected condition and instead of the shoulder having an integral arm 24 for resisting rail flange uplift, the shoulder member may be apertured or notched and may cooperate with a further separate clip member that provides the arm member and engages with the shoulder member 11 and with the upper side of the rail flange 41. various known forms of apertured or notched shoulder member and rail flange engaging clip member are known, for example from applicant's international patent applications Nos. WO 94/28245 and WO 96/23017 referred to above, from which further details may be obtained. In such case, the rod form clip 60 may function as described above to prevent rotation of the shoulder to a position in which the shoulder and rail flange engaging clip are rotated away from engagement with the rail flange 41.

Further, while in the example described above with reference to the drawings, the rod form clip snap fits on opposing lateral sides of the arm 24 and extends generally forwardly therefrom, other arrangements are contemplated for engagement of the rod form clip on the shoulder member. For example, although with less advantage, the transverse limb in the installed position of the clip 60 may extend rearwardly downwardly toward the rear side of the upper rectangular portion 22, and the further longitudinal limb 60 may engage rearwardly of the portion 22 adjacent the fillet 21.

It may be noted that the lower limb 61 is substantially longer, for example 20% to 50% longer, than the length of the linear side 31 of the shoulder 11 so that, in the event the transverse limb 64 becomes disengaged from the outer wall 29 and retracts to an intermediate position engaging the inclining upper side of the recess 27, a substantial portion of the lower limb 61 remains extending between the side surface 31 and the rail flange 41, and thus maintains its functions of maintaining the shoulder 11 erect and resisting its rotation outwardly away from the rail flange 41. Preferably, the length of the lower limb 61 is greater than the length of the lower side 31 by an amount at least equal to the distance between the outer side of the outer wall portion 29 and the inner side of the opposite wall portion 28 so that, even in an extreme position wherein the inner side of the transverse limb 64 engages the inner side of the wall portion 28, the lower limb portion 61 extends along substantially the whole of the side surface 31.

Where the rail 40 is subjected to usual lateral stresses, normally a single shoulder member 11 and clip 60 disposed on the tie 52 on each side of the rail, and preferably arranged diametrically, as seen in FIGS. 1 and 5, will be sufficient to maintain gauge. In zones of higher stress, the fastening may be doubled up by disposing a shoulder 11 through each of the two openings 53 on each side of the rail 40, each provided with a rod clip 60 as described above.

What is claimed is:

1. A retaining device retaining a rail flange of a rail relative to a plate form member comprising:

(A) a shoulder having a body portion, a hook-in leg portion and a bearing portion, said shoulder in an installation position, wherein the body portion is inclined relative to said plate form member, having said hook-in leg portion insertable through an aperture in said plate form member, and said shoulder being pivotable from said installation position to an erected position, wherein the hook-in leg portion engages an underside of said plate form member and said bearing portion engages on an upper side of said plate form member; and wherein said shoulder is provided with an arm extending transversely of said body portion and extending above and bearing toward said rail flange, a side surface disposed on a side of said body portion below the arm, and opposite end surfaces on said arm facing generally longitudinally of said rail; and (B) a clip member located relative to the shoulder by engagement therewith and comprising first and second upper limbs said first upper limb engaging one of said end surfaces on said arm, and said second upper limb snapfitting over the other of said end surfaces on said arm, and a lower limb inserted between said side surface of said body portion and said rail flange and retaining said shoulder in said erected position and preventing rotation of said shoulder about a vertical axis.

2. A rail retaining device according to claim 1, wherein said side surface comprises a linear portion defining a linear cavity extending between said side surface and the rail flange and said lower limb of said clip member occupies said cavity.

3. A rail retaining device according to claim 2 wherein said lower limb of said clip member is substantially longer than said side surface.

4. A rail retaining device according to claim 1 wherein said clip comprises resilient rod material.

5. A rail retaining device according to claim 1 wherein said arm extends generally parallel to said hook-in leg portion.

6. A rail retaining device according to claim 5 wherein said arm extends generally vertically above said hook-in leg portion.

7. A rail retaining device according to claim 5 wherein said bearing portion comprises a member extending from said body in a direction generally opposite to said arm.

8. A rail retaining device according to claim 1, wherein said clip comprises resiliently deflectable material and has a generally C-shaped lower portion having said lower limb extending between said side surface and said rail flange and said first upper limb connected to and deflectable resiliently with respect to the lower limb, an upper limb portion connected to said first upper limb, and said second upper limb extending transversely from said upper limb portion and snapfitting over said other of said end surfaces when said lower limb is driven inwardly between said side surface and said rail flange.

9. A rail retaining device according to claim 8, wherein said arm has a recess in an upper surface thereof and said second upper limb snap fits initially in said recess and subsequently over said other of said end surfaces of the arm when said lower limb is driven inwardly between said side surface and said rail flange.

10. A rail retaining device according to claim 9, wherein said lower limb is longer than said side surface by a distance at least approximately equal to the distance between said other of said end surfaces of the arm and an inner end of the recess remote from said one end surface.

11. A rail retaining device according to claim 8, wherein said second upper limb is provided with a longitudinal limb that, in an installed position, reacts resiliently with, and is deflected resiliently upwardly from a neutral position by contact with, an upper side of the rail flange.

12. A rail retaining device according to claim 11, wherein said longitudinal limb extends on the same side of the second upper limb as said upper limb portion.

* * * * *